US008590720B2

(12) United States Patent
Thomas, II

(10) Patent No.: US 8,590,720 B2
(45) Date of Patent: Nov. 26, 2013

(54) FORKPOCKETED TANK CONTAINER

(76) Inventor: Terrance R. Thomas, II, Federal Way, WA (US)

( * ) Notice: Subject to any disclaimer, the term of this patent is extended or adjusted under 35 U.S.C. 154(b) by 992 days.

(21) Appl. No.: 12/357,337

(22) Filed: Jan. 21, 2009

(65) Prior Publication Data

US 2009/0184114 A1 Jul. 23, 2009

Related U.S. Application Data

(60) Provisional application No. 61/022,298, filed on Jan. 18, 2008.

(51) Int. Cl.
*B65D 90/12* (2006.01)

(52) U.S. Cl.
USPC ..... 220/1.5; 220/565; 220/562; 220/23.91; 206/386

(58) Field of Classification Search
USPC ..... 220/1.5, 565, 562, 23.91, 668, 628; 206/386
See application file for complete search history.

(56) References Cited

U.S. PATENT DOCUMENTS

| | | | | |
|---|---|---|---|---|
| 3,814,290 | A * | 6/1974 | Gerhard | 222/143 |
| 4,098,426 | A * | 7/1978 | Gerhard | 220/1.5 |
| 7,997,441 | B2 * | 8/2011 | Marcel | 220/647 |
| 2007/0151971 | A1 * | 7/2007 | Petzitillo et al. | 220/1.5 |
| 2009/0134171 | A1 * | 5/2009 | deBerardinis | 220/562 |

* cited by examiner

*Primary Examiner* — Stephen Castellano
(74) *Attorney, Agent, or Firm* — Lowe Graham Jones PLLC

(57) ABSTRACT

A framework for support of a tank within the framework includes four corner posts joined by four top rails and four bottom rails together defining a rectangular prism. At least one of the rails includes a forkpocket assembly. The forkpocket assembly includes at least one forkpocket protection plate. The forkpocket protection plate defines a pair of forkpocket tubes configured to receive tines of a forklift. The forkpocket tubes are situated at a vertical forkpocket height selected to be removed from the tank vertical profile of a framework profile. A vertical protection plate extends vertically over a portion of the tank vertical profile of a framework profile.

14 Claims, 2 Drawing Sheets

FORKPOCKETED TANK CONTAINER

PRIORITY CLAIM

This application claims priority from a provisional filing dated Jan. 18, 2008, having Ser. No. 61/022,298 and bearing the same title as the instant application.

FIELD OF THE INVENTION

This invention relates generally to Containerized Shipping Containers and, more specifically, to Gaseous and Liquid Product Containers.

BACKGROUND OF THE INVENTION

Chemical incidents can be caused by the breach in the wall of the tank containing the chemical. The most common container breaches are punctures in the barrel of the tank caused by incursion by one of the tines of a forklift. Where the tank contains a reactive liquid, the puncture of the tank may cause a violent reaction having catastrophic consequences. When the tank contains a flammable liquid or gas, such as propane, puncture by tine incursion may cause detonation of the flammable liquid. After the fact studies of such detonations show that a fully laden tank can travel upwards of a mile from the point of impact. Even without detonation, puncture of the tank can cause the aerosol dispersion of the contents over a wide area. Where hazardous materials can cause injury to persons, animals, and vegetation, the wide dispersion of the materials may be catastrophic. Winds may further disperse the contents over a far broader area. Where the winds carry the hazardous materials to taint water, the tainted water poses a further danger.

One such incident occurred in Australia on Feb. 8, 2002. Hundreds of fish were killed in an area extending from the Georges River and further along into Botany Bay as the result of a fork lift puncture of a tank containing pesticide. The tine of the forklift punctured the tank at a depot in the nearby suburb of Wetherill. Water carried the pesticide from the tank into the Georges River where the pesticide killed the fish. As the tainted water ran down the river to Botany Bay, oysters in the wild and in farms at the Georges delta were decimated.

The art is missing a framework for carrying a tank that will prevent tank puncture by forklift tines.

SUMMARY OF THE INVENTION

A framework for support of a tank within the framework includes four corner posts joined by four top rails and four bottom rails together defining a rectangular prism. At least one of the rails includes a forkpocket assembly. The forkpocket assembly includes at least one forkpocket protection plate. The forkpocket protection plate defines a pair of forkpocket tubes configured to receive tines of a forklift. The forkpocket tubes are situated at a vertical forkpocket height selected to be removed from the tank vertical profile of a framework profile. A vertical protection plate extends vertically over a portion of the tank vertical profile of a framework profile.

By removing the forkpockets from the immediate vicinity of the vulnerable tank, the likelihood of rupture drops greatly. In one embodiment, the framework is also configured to allow containerized shipment of the tank employing conventional means. Operators use forklifts for delivering containers to and from land vehicles, such as trucks and rail cars.

In accordance with still further examples of the invention, a forkpocket assembly is used as a rail in a framework having four cornerposts. The framework is configured for support of a tank within the framework. The forkpocket assembly includes a rail extending from a first cornerpost to a second cornerpost. At least one forkpocket protection plate is attached to the rail. The at least one forkpocket protection plate defines a pair of forkpocket tubes configured to receive tines of a forklift. The forkpocket tubes are situated at a vertical forkpocket height selected to be removed from the tank vertical profile of a framework profile. A vertical protection plate extends vertically over a portion of the tank vertical profile of a framework profile.

In accordance with still further examples of the invention, a framed tank includes a tank, having a tank vertical profile projected upon a framework profile, and a framework for supporting the tank. The framework includes four corner posts joined by four top rails and four bottom rails together defining a rectangular prism. At least one of the rails includes a forkpocket assembly. The forkpocket assembly includes at least one forkpocket protection plate. The at least one forkpocket protection plate defines a pair of forkpocket tubes configured to receive tines of a forklift. The forkpocket tubes are situated at a vertical forkpocket height selected to be removed from the tank vertical profile of a framework profile. A vertical protection plate extends vertically over a portion of the tank vertical profile of a framework profile.

These and other examples of the invention will be described in further detail below.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

A framework for support of a tank within the framework includes four corner posts joined by four top rails and four bottom rails together defining a rectangular prism. At least one of the rails includes a forkpocket assembly. The forkpocket assembly includes at least one forkpocket protection plate. The forkpocket protection plate defines a pair of forkpocket tubes configured to receive tines of a forklift. The forkpocket tubes are situated at a vertical forkpocket height selected to be removed from the tank vertical profile of a framework profile. A vertical protection plate extends vertically over a portion of the tank vertical profile of a framework profile.

Figure 1:
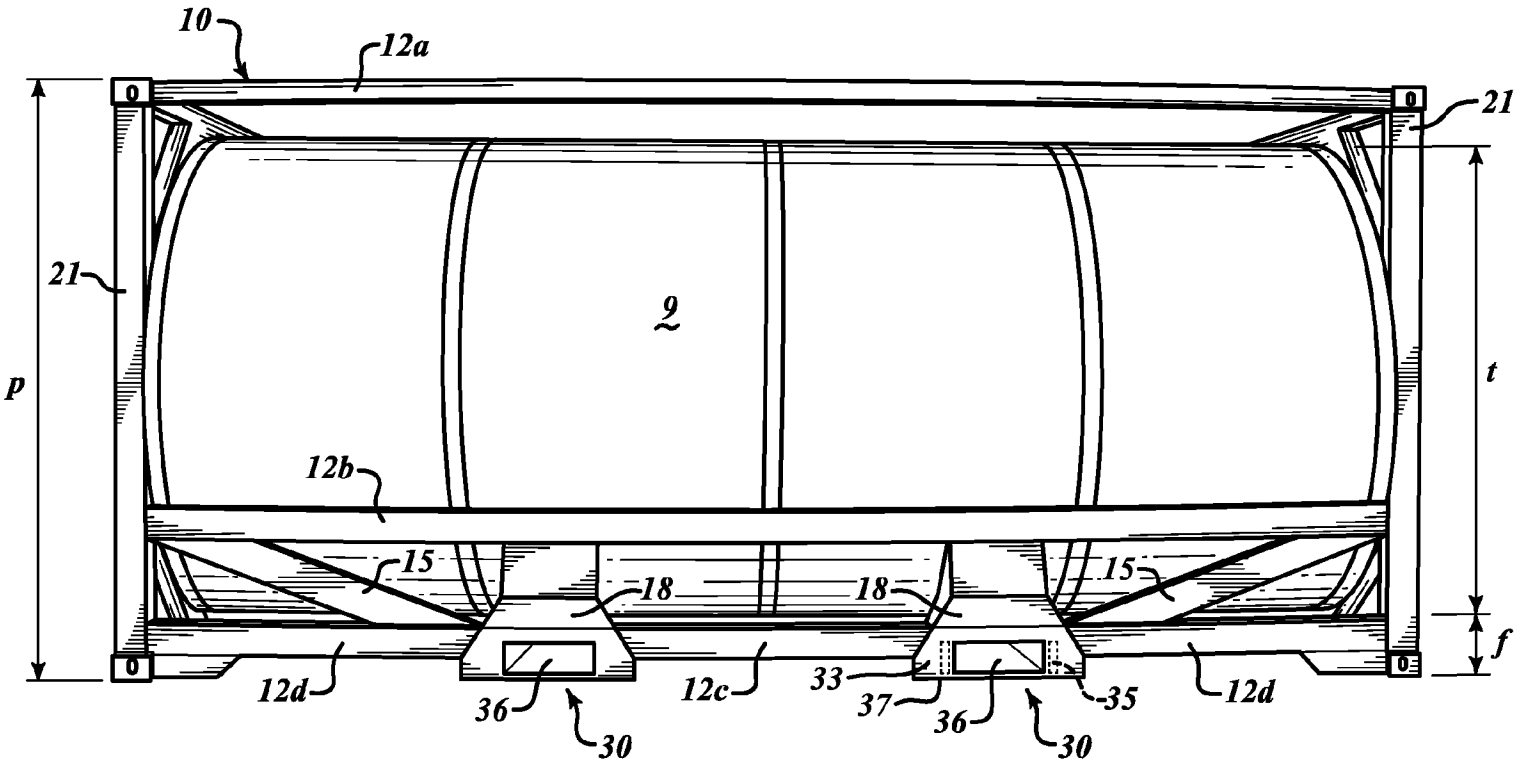
FIG. 1 is a side view of one embodiment of the inventive framework and a tank.
Figure 2:
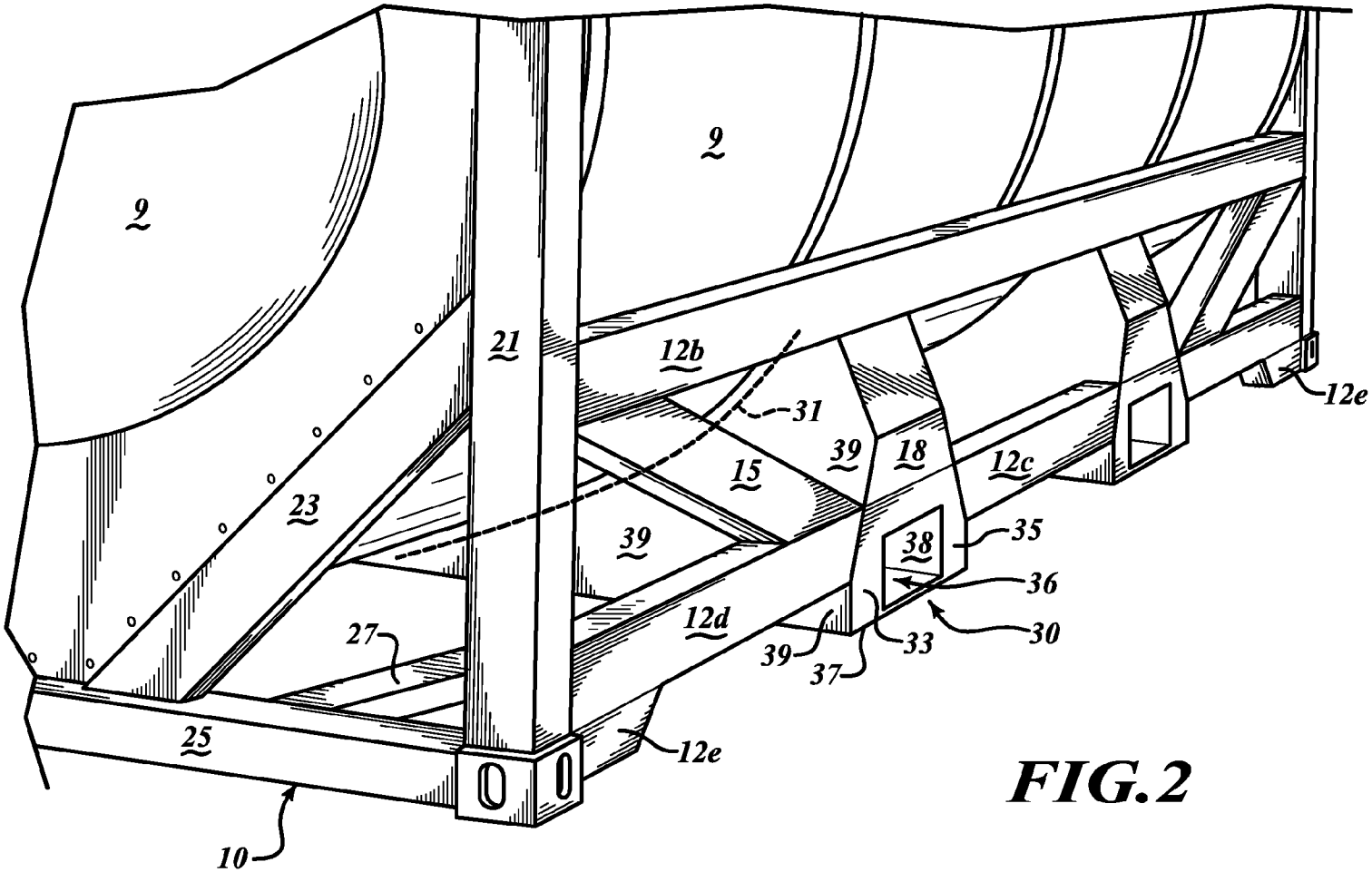
FIG. 2 is an isometric view of a forkpocket assembly within one embodiment of the inventive framework.

FIG. 1 displays a nonlimiting embodiment of an intermodal ISO-IMO Tank (tank) 9 having a framework including full lift forkpockets (framework) 10. While FIG. 1 shows a first embodiment, this description is not limited to the embodiment of the framework shown in FIG. 1. Four other non-limiting embodiments of the invention are also included in this discussion of the exemplary embodiment. First, in the exemplary embodiment shown in FIG. 1, the forkpocket assembly 30 is shown to be affixed to a bottom side rail of the framework 10 in a frame tank embodiment. The forkpocket assembly 30 can be equally useful in the position of the top side rail 12*a* rather than that of the bottom side rail (shown as inner and outer bottom side rails 12*c* and 12*d* respectively). Additionally, rather than the frame tank embodiments, the same invention can be configured in a beam tank configuration where the forkpocket assembly is located on either of a top front rail (not pictured) or a bottom front rail 25 (FIG. 2). Because the details of each nonlimiting embodiment have the same function in each of the exemplary embodiments, one exemplary embodiment is discussed without further limitation of the invention to the embodiment shown.

In the exemplary embodiment of the framework, the tank 9 is enclosed and supported by the framework 10. Generally configured to be contained within a rectangular prism, four elements visible here define a rectangular side to that prism—two upright cornerposts 21 meet a top side rail 12*a* and a bottom side rail shown in this nonlimiting embodiment as an inner bottom side rail 12*c* conjoined to two outer bottom side rails 12*d*. To further strengthen the framework 10 at the rectangular side, an intermediate side rail 12*b* extends, as well, from cornerpost 21 to cornerpost 21. Additionally, where the cornerpost 21 meets the outer bottom side rail 12*d*, a casting reinforcement tube 12*e* provides greater web area at the joint.

When taken together, in this exemplary embodiment, the intermediate side rail 12*b*, the inner bottom side rail 12*c* and two outer bottom side rails 12*d* as well as the portions of the cornerposts 21 that extend from the intermediate side rail 21*b* to the two outer bottom side rails 12*d* to define an outer perimeter of a forkpocket assembly 30.

Between the inner bottom side rail 12*c* and the outer bottom side rails 12*d*, a forkpocket entry protection plate 33 in conjunction with a forkpocket strap 37 defines an entry to the forkpocket tube 36.

In the exemplary embodiment the forkpocket entry protection plate 33 is shown having two optional forkpocket entry reinforcement plates 35 flanking the forkpocket tube 336. Additionally, the forkpocket entry protection plates 33 are shown as distinct plates. In an alternate embodiment, the forkpocket entry protection plate 33 is a single plate defining two forkpocket tubes 36 configured to accept two tines of a forklift.

The forkpocket assembly 30 is further reinforced by side diagonals 15 extending from the forkpocket entry protection plate 33 to where the intermediate side rail 12*b* meets the cornerpost 21. Additionally, a vertical protection plate 18 extends from the forkpocket protection plate 33 to the intermediate side rail 12*b* thereby preventing accidental incursion into the tank 9 by tines of a forklift adjusted to a height above that of the forkpocket tube 36, while lending further strength and rigidity to the framework 10.

As described, each of the embodiments of the invention enjoy a particular advantage in affording protection to the tank 9. As pointed out, four elements visible here define the rectangular side to the prism—two upright cornerposts 21 meet the top side rail 12*a* and the bottom side rail shown in this nonlimiting embodiment as an inner bottom side rail 12*c* conjoined to two outer bottom side rails 12*d*. Vertically, the side has a dimension or framework profile p extending from the top side rail 12*a* to the bottom side rail. The tank 9 occupies a tank vertical profile t of that framework profile p while the bottom side rail occupies a distinct portion of the framework profile p the forkpocket segment f. The forkpocket segment f is always selected to be at a vertical height distinct from the height of the tank. Thus, where the tines of the forklift are set at a proper height for engaging the framework 9 at the forkpocket tube 36, the tines cannot reach the tank 9 for incursion even if the tines are not suitably aligned to the forkpocket tube 36 horizontally. No incursion can occur.

Thus, to cause an incursion to the tank 9, the tines of a forklift must be misaligned to the forkpocket tube 36 both horizontally and vertically because of the forkpocket assembly 30. The vertical protection plate 18 protects the tank 9 against incursion between the bottom side rail comprising the inner bottom side rail 12*c* and the outer bottom side rails 12*d* and the intermediate side rail 12*b*. The fact that the tank vertical profile t is vertically removed from the forkpocket segment f, assures that failure to align to forkpocket tube 36 horizontally will not allow incursion into the tank 9.

In addition to the vertical separation of the forkpocket tube 36 from the tank vertical profile t, the forkpocket assembly 30 reinforces the framework 10. As shown in FIG. 2, the vertical protective plate 18 is joined to a saddle plate 31 for support of the tank 9 within the framework. Saddle side plates 39 add further rigidity to the saddle. The saddle side plates 39 extend from the saddle plate 31 to the forkpocket strap 37 and extend to a second bottom side rail (not shown) on an opposite side of the framework to support the saddleplate 31 as it cradles the tank 9.

As is evident in FIG. 2, the forkpocket tube 36 is defined by the forkpocket strap 37 in conjunction with the forkpocket tube sidewalls 38. A forkpocket tube topwall (not shown) completes the forkpocket tube 36 and provides a bearing surface for the tines of the fork as it is used to lift the framework 10 and tank 9. Further support for the tank 9 within the framework 10 is provided by a tank endpiece 9' cooperating with the framework 10 at the bottom front rail 25 and a diagonal brace 23.

While the preferred embodiment of the invention has been illustrated and described, as noted above, many changes can be made without departing from the spirit and scope of the invention. For example, as noted above, the forkpocket assembly 30 may be located at any of the bottom side rail (FIGS. 1, 2), the top side rail 12*a*, the bottom front rail 25, or the top front rail (not shown). Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A framework for support of a tank within the framework, the framework comprising:

four corner posts joined by four top rails and four bottom rails together defining a rectangular prism wherein at least one of the rails includes a forkpocket assembly, the forkpocket assembly including:

at least one forkpocket protection plate, the at least one forkpocket protection plate defining at least one forkpocket tubes configured to receive tines of a forklift, the defined forkpocket tubes being two in number and situated at a vertical forkpocket height selected to be removed from the tank vertical profile of a framework profile; and at least one vertical protection plate extending vertically from each forkpocket protection plate a portion of which to be vertically aligned with at least one forkpocket tube and extending over a portion of the tank vertical profile of a framework profile.

2. The framework of claim 1, wherein the framework and tank form a frame tank and the rail including the forkpocket assembly is a bottom side rail.

3. The framework of claim 1, wherein the framework and tank form a frame tank and the rail including the forkpocket assembly is a top side rail.

4. The framework of claim 1, wherein the framework and tank form a beam tank and the rail including the forkpocket assembly is a bottom front rail.

5. The framework of claim 1, wherein the framework and tank form a frame tank and the rail including the forkpocket assembly is a top front rail.

6. The framework of claim 1, wherein the rail includes an inner rail and two outer rails.

7. A framed tank comprising:

a tank having a tank vertical profile projected upon a framework profile; and a framework for supporting the tank, the framework including:

four corner posts joined by four top rails and four bottom rails together defining a rectangular prism wherein at least one of the rails includes a forkpocket assembly, the forkpocket assembly including:

at least one forkpocket protection plate, the at least one forkpocket protection plate the at least one fork pocket plate together defining a pair of forkpocket tubes configured to receive tines of a forklift, the forkpocket tubes being situated at a vertical forkpocket height selected to be removed from the tank vertical profile of a framework profile; and at least one vertical protection plate originating at the at least one forkpocket protection plate and extending such that a portion of the at least one vertical protection plate extends vertically in alignment with each of the two defined forkpocket tubes over a portion of the tank vertical profile of a framework profile.

8. The framed tank of claim 7, wherein the framework and tank form a frame tank and the rail including the forkpocket assembly is a bottom side rail.

9. The framed tank of claim 7, wherein the framework and tank form a frame tank and the rail including the forkpocket assembly is a top side rail.

10. The framed tank of claim 7, wherein the framework and tank form a beam tank and the rail including the forkpocket assembly is a bottom front rail.

11. The framed tank of claim 7, wherein the framework and tank form a frame tank and the rail including the forkpocket assembly is a top front rail.

12. The framed tank of claim 7, wherein the rail includes an inner rail and two outer rails.

13. The framed tank of claim 7, wherein the tank further comprises a tank endpiece attached to two cornerposts and configured for support of the tank.

14. The framed tank of claim 7, wherein the vertical protection plates are attached to a saddle plate.

* * * * *